US005682614A

United States Patent [19]

Lazarus

[11] Patent Number: 5,682,614

[45] **Date of Patent: *Nov. 4, 1997**

[54] SPORTS GLOVE WITH ASYMMETRICAL THUMB SEAM PATTERN

[75] Inventor: Alan H. Lazarus, Cincinnati, Ohio

[73] Assignee: Boyce-Lazarus Corporation, Cincnnati, Ohio

[ * ] Notice: The term of this patent shall not extend beyond the expiration date of Pat. No. 5,515,548.

[21] Appl. No.: 650,300

[22] Filed: May 13, 1996

Related U.S. Application Data

[63] Continuation-in-part of Ser. No. 236,119, May 2, 1994, Pat. No. 5,515,548.

[51] Int. Cl.[6] ..... A41D 19/00

[52] U.S. Cl. ..... 2/169; 2/161.2

[58] Field of Search ..... 2/161.2, 161.1, 2/159, 163, 169

[56] References Cited

U.S. PATENT DOCUMENTS

| | | | |
|---|---|---|---|
| 144,665 | 11/1873 | Foster | 2/169 |
| 666,853 | 1/1901 | Morgan | 2/169 |
| 692,224 | 2/1902 | Baird | 2/169 |
| 975,289 | 11/1910 | Sachs | 2/169 |
| 1,252,900 | 1/1918 | Grinnell | 2/169 |
| 4,858,245 | 8/1989 | Sullivan et al. | 2/169 |
| 5,175,886 | 1/1993 | Suk | 2/161.2 |

*Primary Examiner*—Michael A. Neas
*Attorney, Agent, or Firm*—John M. Brandt

[57] ABSTRACT

A sport glove thumb portion wherein the joining inseam is asymmetrical and located above the tip and on the back of the thumb. A pattern and seam arrangement are also disclosed.

2 Claims, 1 Drawing Sheet

SPORTS GLOVE WITH ASYMMETRICAL THUMB SEAM PATTERN

CROSS REFERENCE TO RELATED APPLICATIONS

This application is a continuation in part of Ser. No. 08/236,119 filed May 2, 1994 now U.S. Pat. No. 5,515,548 issued May 14, 1996.

FIELD OF THE INVENTION

The invention resides in the field of sports gloves and more particularly relates to thumb seam location in a gripping glove such as a golf glove.

BACKGROUND OF THE INVENTION

Typically, gripping gloves for securely holding sports implements such as golf clubs are made of leather or leather-like material and are designed to fit very snugly and conform perfectly to the shape of the wearer's hand. The intent is to create a second skin wherein the grip on the sports implement for example, a golf club, is substantially improved without interfering with the natural action of the user.

Thumbs for such gloves have heretofore been cut from one piece of material in a symmetrical shape known as the Bolton pattern. In the finished product, the seam joining the two sides of the thumb portion is positioned at the tip of the thumb and thumbnail.

As this is a contact point in the employment of a proper grip, particularly in the handling of golf clubs, this tip of the thumb seam position in prior art gloves can interfere with an optimum contact creating an annoyance in the wearer.

The present invention is directed to the repositioning of the seam from the tip and side of the thumb to the back of the thumbnail to eliminate this undesirable contact interference and thereby improve the performance of the user. The form of seam used in the construction is preferably and advantageously an inseam.

SUMMARY OF THE INVENTION

The invention may be summarized as an improvement in a sports glove, in which the thumb inseam is positioned over the back of the thumbnail rather than the tip and side of the thumb as is the present case. This is accomplished utilizing a thumb pattern which is asymmetrical rather than symmetrical having a central palm portion and two opposed wing portions attached thereto.

The palm portion is the shape of a full thumb including the sides and the wing portions are each the shape of a half of a back of a thumb and are sized such that when folded over and joined to each other with a central lateral inseam and joined to the palm portion by a cross inseam, the relocation of the thumb seam to the back of the thumbnail is achieved.

In use the point of thumb contact in a standard golf club grip is therefore covered by just the material of which the glove is fabricated and is essentially seam free.

These and other features and advantages of the invention will be more fully understood from the description of the preferred embodiment and drawings which follows.

DESCRIPTION OF THE PREFERRED EMBODIMENT

Figure 1:
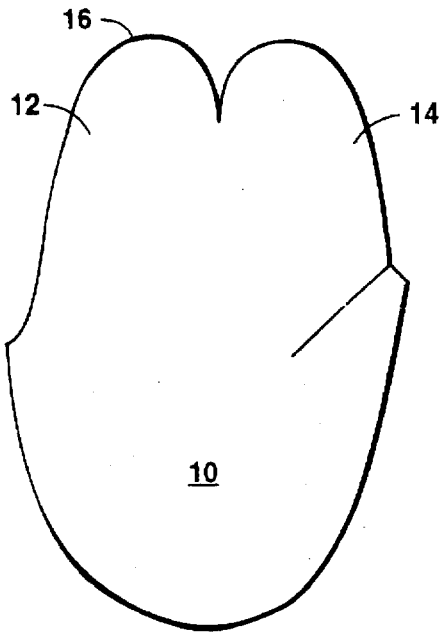
FIGURE 1 PRIOR ART
FIG. 1 is a plan view of a glove thumb pattern of the prior art.
Figure 3:
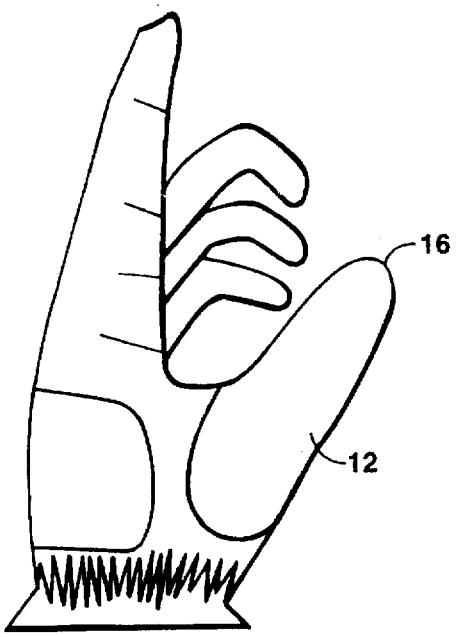
FIGURE 3 PRIOR ART
FIG. 3 is a plan view of the completed thumb of the pattern of FIG. 1.

Referring first to FIG. 1 there is shown a plan view of a glove thumb pattern of the prior art known as the Bolton pattern. Pattern 10, comprised of any suitable material for example, fabric or leather, is composed of two essentially symmetrical portions 12 and 14. In the fabrication of the glove, the pattern is folded over and sewn along line 16 forming a seam as is shown in FIG. 3 which rests atop the thumb of the user. It will be understood that in the nomenclature of glove manufacturing the direction known as above is that away from the fingers and toward the waist.

Figure 2:
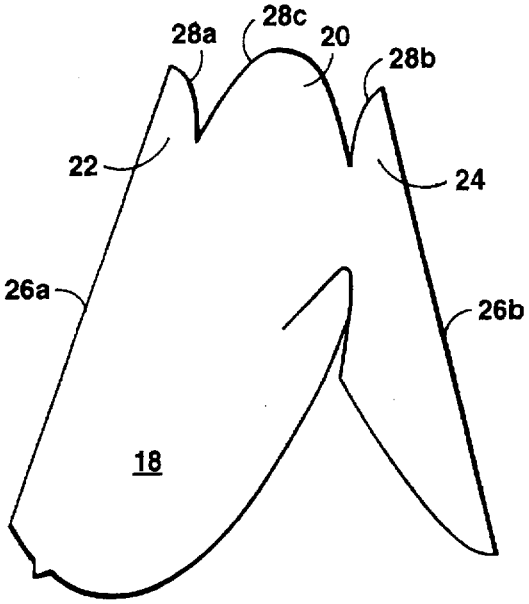
FIG. 2 is a plan view of the glove thumb pattern of the preferred embodiment of the invention.

FIG. 2 illustrates the pattern used to construct the thumb of the preferred embodiment of the invention. Pattern 18 consists of a central palm portion 20 which is of sufficient size to wrap around and form the sides of the thumb. Two opposed wing portions 22 and 24 are attached to and integral with central portion 20 and are of sufficient size to each form one half the back of the thumb.

Figure 4:
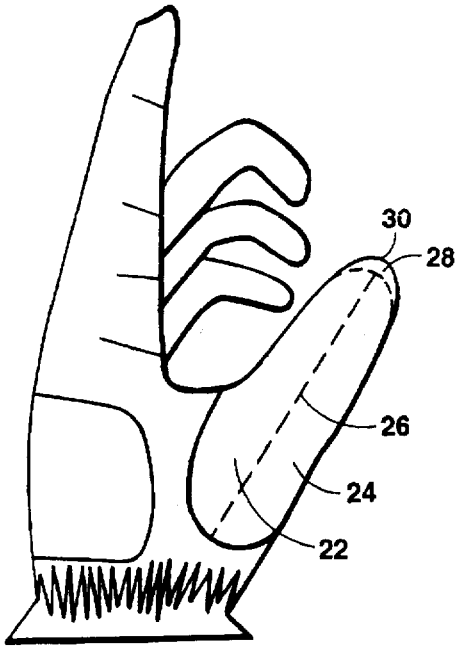
FIG. 4 is a plan view of the completed thumb of the pattern of FIG. 2.

Two separate inseams are used to secure the above portions into a finished thumb. One is a lateral inseam formed by attaching edges **26*a* and 26*b* and the other is a cross inseam formed by attaching edges 28*a*, 28*b* and 28*c*. The resulting construction is shown in FIG. 4 where like numbers refer to like components of FIG. 2. As will be seen, inseam 28 is above the apex 30** of the thumb on the hand of the user and rests on the back of the thumbnail rather than the tip as has heretofore been explained.

Figure 5:
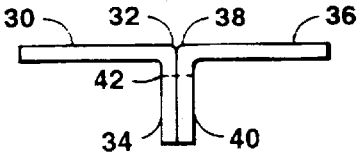
FIG. 5 is a cross sectional view of the form of the seam utilized in the preferred embodiment of the invention.

FIG. 5 illustrates in cross section the form of seam known as an inseam which is preferably and advantageously used in the construction of the aforementioned glove. A first material portion 30 is folded over at 32 to form an inner portion 34 and the second material portion 36 to be joined to the first is folded over at 38 to form inner portion 40. Inner portions 34 and 40 are then stitched by a thread 42 to join material portions 30 and 36 on the inside of the glove.

As variations in the above described construction might be made in order to obtain the same resulting configuration, the invention is hereby defined by the following claims.

What is claimed is:

1. In a sport glove comprised of a flat pattern of selected material formed into a finished thumb covering unit having a tip, palm, and back portion by joining edges of the pattern by a non-overlapping inseam, the improvement which comprises locating said inseam above the tip of said unit and on said back of said unit, said inseam arranged to lie within that part of said back portion which when in use will cover the thumbnail of the wearer.

2. The thumb unit of claim 1 wherein said non-overlapping inseam follows the curvature of the tip of the thumb of the wearer.

* * * * *